US011850503B2

(12) United States Patent
Gomez

(10) Patent No.: US 11,850,503 B2
(45) Date of Patent: Dec. 26, 2023

(54) APPARATUS FOR PLAYING BILLIARDS GAMES

(71) Applicant: Eduardo Roberto Gomez, Plantation, FL (US)

(72) Inventor: Eduardo Roberto Gomez, Plantation, FL (US)

( * ) Notice: Subject to any disclaimer, the term of this patent is extended or adjusted under 35 U.S.C. 154(b) by 71 days.

(21) Appl. No.: 17/271,819

(22) PCT Filed: Aug. 28, 2018

(86) PCT No.: PCT/US2018/048293

§ 371 (c)(1),
(2) Date: Feb. 26, 2021

(87) PCT Pub. No.: WO2020/046277

PCT Pub. Date: Mar. 5, 2020

(65) Prior Publication Data

US 2021/0316204 A1 Oct. 14, 2021

(51) Int. Cl.
*A63D 15/10* (2006.01)
*A41D 19/00* (2006.01)

(52) U.S. Cl.
CPC ..... *A63D 15/105* (2013.01); *A41D 19/0024* (2013.01)

(58) Field of Classification Search
CPC ..... A63D 15/105; A41D 19/0024
USPC ..... 473/42–43
See application file for complete search history.

(56) References Cited

U.S. PATENT DOCUMENTS 529,731 A * 11/1894 Gschwendtner ..... A63D 15/105 473/43
570,459 A * 11/1896 Cronin ..... A63D 15/105 473/43
870,491 A * 11/1907 Callaghan ..... A63D 15/105 473/43
1,149,834 A * 8/1915 James ..... A63D 15/105 473/43
1,362,461 A * 12/1920 Anast ..... A63B 71/146 2/2

(Continued)

FOREIGN PATENT DOCUMENTS

CN 2445779 5/2001
GB 2152390 A 2/1984

(Continued)

OTHER PUBLICATIONS

International Search Report and Written Opinion for PCT/US2018/048299 of the U.S. Patent and Trademark Office dated Nov. 7, 2018, 15 pp.

(Continued)

*Primary Examiner* — Mitra Aryanpour
(74) *Attorney, Agent, or Firm* — Edwin S. Flores; Daniel J. Chalker; Chalker Flores, LLP

(57) ABSTRACT

The invention includes an apparatus and method for playing billiard games including a cue glove with an easily attachable cue pilot guide to slide the cue shaft providing control to the player's stroke. In addition, the invention presents a Y-shaped lanyard attachable to the glove base allowing the player to perform an "air bridge" stroke. The apparatus improves the movements of the la er in all directions.

15 Claims, 7 Drawing Sheets

(56) References Cited

U.S. PATENT DOCUMENTS

| | | | | | |
|---|---|---|---|---|---|
| 1,483,595 | A * | 2/1924 | Read | A63B 60/10 | 2/21 |
| 1,682,361 | A * | 8/1928 | Von Halle | A41C 1/00 | 2/255 |
| 3,411,779 | A | 11/1968 | McGowan | | |
| 3,544,111 | A * | 12/1970 | Kluber | A63D 15/006 | 473/43 |
| 3,711,091 | A | 1/1973 | Dixon | | |
| 4,025,962 | A * | 5/1977 | Hartung | A63B 71/148 | 473/43 |
| 4,053,153 | A | 10/1977 | Josenhans | | |
| 4,064,563 | A * | 12/1977 | Stokes | A63B 71/148 | 473/43 |
| 4,147,346 | A | 4/1979 | Gianetti | | |
| 4,151,990 | A | 5/1979 | Josenhans | | |
| 4,178,694 | A | 12/1979 | Bonney et al. | | |
| 4,268,033 | A | 5/1981 | Fontaine | | |
| 4,461,043 | A | 7/1984 | Lomedico | | |
| 4,573,220 | A * | 3/1986 | Baker | A63B 71/148 | 2/21 |
| 4,877,242 | A * | 10/1989 | James | A63D 15/08 | 473/46 |
| 5,003,637 | A * | 4/1991 | Lonon | A41D 19/0024 | 2/160 |
| 5,238,457 | A * | 8/1993 | Triplett | A63D 15/105 | 473/42 |
| 5,322,475 | A | 6/1994 | Irvin | | |
| 5,597,360 | A | 1/1997 | Freedenberg | | |
| 5,769,728 | A | 6/1998 | Kasino | | |
| 5,853,333 | A | 12/1998 | Patterson | | |
| 5,954,589 | A | 9/1999 | Masters | | |
| 6,042,481 | A | 3/2000 | Walker et al. | | |
| 6,402,628 | B1 | 6/2002 | Neil | | |
| 6,929,555 | B2 | 8/2005 | Morton | | |
| 7,303,483 | B2 | 12/2007 | Black | | |
| 8,523,693 | B2 | 9/2013 | Nelson | | |
| 8,870,669 | B1 | 10/2014 | Griffen et al. | | |
| 9,067,126 | B2 * | 6/2015 | Lucero | A63D 15/105 | 473/43 |
| 9,144,731 | B1 * | 9/2015 | Brooks | A63D 15/105 | 473/43 |
| 9,539,492 | B1 | 1/2017 | Eager | | |
| 10,245,501 | B2 | 4/2019 | Klimeck | | |
| 10,350,480 | B2 * | 7/2019 | Manou | A63D 15/105 | 473/43 |
| 2004/0031120 | A1 | 2/2004 | Cherian | | |
| 2007/0079421 | A1 * | 4/2007 | Davis | A63B 71/148 | 2/163 |
| 2007/0219008 | A1 | 9/2007 | Deakes | | |
| 2008/0125233 | A1 | 5/2008 | Tucker | | |
| 2009/0258718 | A1 | 10/2009 | Cyr | | |
| 2010/0314427 | A1 | 12/2010 | Cartwright | | |
| 2015/0065262 | A1 * | 3/2015 | Lucero | A63D 15/105 | 473/43 |
| 2021/0228974 | A1 * | 7/2021 | Park | F21V 33/008 | 473/43 |
| 2021/0316204 | A1 * | 10/2021 | Gomez | A41D 19/0024 | 473/43 |
| 2022/0072411 | A1 | 3/2022 | Bragg | | |
| 2022/0258034 | A1 * | 8/2022 | Webb | A63D 15/105 | 473/43 |

FOREIGN PATENT DOCUMENTS

| | | | |
|---|---|---|---|
| GB | 2196867 | A | 5/1988 |
| GB | 2224945 | A1 | 5/1990 |
| GB | 2348149 | A | 9/2000 |
| GB | 2578130 | A | 4/2020 |
| WO | 2020046277 | A1 | 3/2020 |
| WO | 2020046279 | A1 | 3/2020 |
| WO | 2020101647 | A1 | 5/2020 |

OTHER PUBLICATIONS

International Search Report and Written Opinion for PCT/US2018/060638 of the U.S. Patent and Trademark Office dated Feb. 19, 2019, 12 pp.

Billiard Ball Sep. 11, 2018, https://en.wikipedia.org/wiki/Billiard_ball, accessed May 12, 2021, 8 pp.

International Search Report and Written Opinion for PCT/US2018/048293 of the U.S. Patent and Trademark Office dated Dec. 20, 2018, 11 pp.

* cited by examiner

APPARATUS FOR PLAYING BILLIARDS GAMES

CROSS-REFERENCE TO RELATED APPLICATIONS

This application is the National Stage of International Application No. PCT/US2018/048293, filed on 28 Aug. 2018, the contents of each of which are incorporated by reference herein.

FIELD OF THE INVENTION

This invention relates to an apparatus for playing or performing games of sports and, more particularly, to the game of billiards or pool. The invention includes a training glove and a cue pilot guide easily attachable and removable from the glove.

BACKGROUND

The game of billiards and pool has been played for many years by a wide variety of people around the world. Pool and billiards are played professionally in many countries. According to the World Confederation of Billiard Sports (hereinafter "WCBS") the popularity of billiards has grown at unprecedented levels in recent times, making pool one of the world's most widely practiced sports. To put billiards in numbers, the WCBS hosts more than 200 competitions around the world, and the participants, just in the United States of America (hereinafter "U.S."), are around 34 million. General revenues from the sales of pool tables and equipment exceeds 2 billion dollars, all while employing more than 32,500 people just in the U.S. Popularity and professionalism of pool and billiards are such that many organizations including the World Professional Billiards and Snooker Association and the WCBS are asking the Olympic Committee to include pool and billiard as an sport for the 2024 Olympic Games.

Despite the sophistication and professionalism reached in pool and billiards, the game is widely played by amateurs and is becoming a fast growing activity among amateurs. The game is played by people who have billiard tables in their homes and, at the same time, is played in pool halls, taverns and recreational centers. Also, billiards games can be played by people of all ages.

Although the popularity of the game is improving, learning the game has been a major task and continues to be a main obstacle to upgrade the performance of amateurs and to increase the popularity of the game. Books, videos, tutorials and devices—many of them expensive and complex—are examples of the different attempts to make the game easier to play and learn.

The present invention, however, will overcome the obstacles mentioned above, being at the same time a device that is affordable, user-friendly and can increase the performance of the players in a very short period of time, while also welcoming first and new players of pool who are frequently discouraged from playing a game that seems reserved only for professionals or very experienced players.

DESCRIPTION OF THE RELATED ART

With a few exceptions and variants, pool and billiard games (pool and billiards used interchangeably) are played mostly with a wood or similar material stick called a "cue". The cues have different shapes and are made with a wide range of materials. While more frequently cues are made of wood (e.g., Maple, Ash or Oak) other cue materials include aluminum, fiber glass and carbon fiber. It does not matter what materials are used to produce them, the structure or parts of a billiard cue include basically two parts: a) a butt end and b) a shaft. The butt includes different parts: i) a bumper at the end of the butt part; ii) a butt cap continues to the bumper; iii) a wrap or grip; and iv) a forearm. The shaft part includes: i) a tapered shaft projecting from the butt end part; ii) a ferrule at the other end of the cue; and finally, iii) a tip that impacts the cue ball. The purpose of the game consists of a billiard player hitting a specific ball (cue ball) making the cue ball roll and hit another ball, inserting the latest mentioned ball into one of the six pockets on a billiard table. In order to hit the cue ball, a billiard player basically grasps the butt end of the cue by the grip with one hand and holds the shaft with the other hand. The right way for a player to hold the cue shaft with his hand is called a bridge. A bridge is formed by placing a hand on the table and spreading the fingers apart such that the cue can smoothly slide between the fingers that hold the cue shaft. Finally, the billiard player executes a shot by moving the cue longitudinally relative to the bridge hand with a stroke.

One of the major problems of pool is to learn how to make a bridge, and more specifically, how to make the right bridge for the right shot. There are many types of bridges and each of them serves its own purpose. One such invention is described in U.S. Pat. No. 3,416,794, that teaches that the bridge is probably the most difficult technique to learn and master. In order to achieve a great stroke, the bridge hand needs to be well positioned and firmly on top of the table with the fingers spread open securing the cue shaft but allowing back and forth movements produced by the back hand. All these actions are difficult to achieve by beginners and amateur players.

Typically, the principal function of a bridge is to lock the cue shaft into a position to reduce or minimize unnecessary sideways movements. Bridges are classified between two principal categories, i) open bridges and ii) closed bridges. The open bridge is frequently used by amateurs and new players since it is easier to form when compared with a closed bridge. In addition, an open bridge is friendlier for newer players since the only requirement for the player is to do a "V" shape form with his/her hand using his/her thumb and his/her index finger allowing the cue stick to move over the angle formed by the "V"-shape. However, an open bridge is very useful when a player needs to make a soft or a follow shot. A closed bridge is used more among professional players. In a closed bridge the thumb, the index and the middle fingers wrap the cue shaft giving the player more control over the movement of the cue stick that allow the player to hit the cue ball with more control and power. How to form and maintain a bridge throughout the shot—whether open or closed—is not the single problem that players face. Another difficulty involving the bridge hand and the cue stick is that the surface and the shape of the player's hand is not the optimal sliding surface for moving the cue stick back and forth, and the problem worsens when the player's hand perspires and/or gets wet making the sliding surface sticky and thus, depriving the cue from the ideal smooth ride. These drawbacks discourage newer players from starting to play and enjoying the game. At the same time it delays the progress of beginners who desire to develop their abilities as quick as possible while keeping them motivated with the game.

Yet other difficulties that are faced by experienced players regarding the formation of a bridge can include: a) when players need to perform an elevated open bridge (e.g. to jump a ball or shoot over an object ball), they usually lose the control and stability of the cue since most of the surface of the fingers that form the bridge miss contact with the table; b) when players form a short closed bridge, they lose visibility on the shot since they lose sight of the shaft due to the index finger being wrapped around the shaft and, at the same time, not having an eye on the back hand (hand on the wrap/grip, this creates another difficulty when the player tries to control the stroke (shot)); c) yet another difficulty is when the players need to shoot the cue ball while the cue ball is making contact with the rail. These are considered among the most difficult strokes in pool and billiard games. Furthermore, in amateur games many discussions and even fights arise when a player—in order to avoid executing the shot from a difficult position—tries to move the cue ball with his/her hand to a different position or intends to separate the cue ball from the rail. Last but not least an important problem occurs when elderly people or people suffering arthritis or people with amputee fingers desire to perform a certain type of bridge.

The use of billiard and pool guides and related devices is known in the prior art. A few patents aim to solve the problem of the cue stick getting stuck or catch or being slow down by the fingers of the players that form the bridge. The purpose of these patents is to provide the pool cue stick with a smooth ride that is created by the use of the glove, glide or a related device. Among the patents included in this group are U.S. Pat. Nos. 4,025,962; 4,064,563; 4,103,362; 8,539,614 and U.S. Design Pat. No. 349,364. Another patent, U.S. Pat. No. 9,067,126 B2, which show a cue hold guide comprising a glove and a cue channel securely attached to the "V" formed by the thumb and the base of the index finger. While this invention attempts to provide the glove with a rigid cue channel member to slide the cue stick towards it, the invention does not offer a realistic and practical training device for many reasons. One reason for that conclusion is given by the fact that the cue channel is positioned in a place that forces the player to adopt an improper position to play. This makes the player stiffen muscles and lock joints in an unnatural and uncomfortable way discouraging him/her from playing the game (e.g. for some shots, the player would need to excessively flex his arm, shoulder or wrist so as to counter the position of the hand that carries the training device). Yet another reason is that the device described does not allow the player to have control on the strike because: a) the device prevents the player from performing closed bridges that are necessary for performing specific shots and having more control over the stroke; and b) the cue channel length is around the same length that is created by putting together the thumb and the index finger, which short length does not prevent sideways movements of the cue stick. Thus, the described invention is not an efficient training tool to perform successfully opening break shots. To perform these shots with the described device, the player needs to focus his/her strength in a sudden and uncontrolled movement. Further, the described device has others drawbacks since: i) it does not prevent the cue stick from getting out the cue channel; ii) it cannot be used when the player needs to form a closed bridge and/or elevated bridge, or, in many situations, when the player needs to form a bridge on the table's rail; iii) the concave shape of the cue channel does not prevent sideways movements thus causing miscues; iv) the rigidity of the cue channel may damage the shaft when the cue stick slides over it; v) the cue channel fixed to the glove makes the bridge hand of the player carry an obstructive member; and finally vi) after some time of use, the cue channel fixed to the glove can break the fabric of the glove due to the continuous force made by the shaft sliding over it.

Another alternative said to provide smoothness to the movement of the cue stick when it goes back and forth to strike the cue ball is introduced by U.S. Pat. No. 9,144,731 and commercial device "The Sleeve™". This device is installed on the cue shaft and provides the player an ergonomic grip to wrap the cue stick. While this device may solve the problem of the cue stick getting stuck or catch or being slow down by the fingers of the players that form the bridge, it actually increases—and not reduce as it is described in the patent—the friction of the cue stick. Then "The Sleeve™" is not capable of reducing any degree of friction of the cue stick. Another problem is that the friction produced by the contact between the device and the cue stick may damage and effectively darken the surface of the shaft of the cue after being used for a certain period of time. Another drawback of "The Sleeve™" is that it cannot be used with open bridges and elevated open bridges since the thumb and the index finger cannot wrap around the device properly. If "The Sleeve™" is just placed over the thumb or over the "V"-shape made by the index and the thumb fingers, it cannot stand and/or grab on the hand, even when the "The Sleeve™" has embossed grip enhancing elements. Thus, any shot, besides a very soft stroke, required during the game would make sideways movements and/or the sleeve getting out of the bridge hand fully when using "The Sleeve™" with an open bridge. An additional sleeve is described in U.S. Pat. No. 5,478,282.

Other alternatives described in the prior art to eliminate or to aid the formation of the bridge so as to provide the players—especially the beginners—with stability in their strokes are represented by a wide diversity of guides or rails. U.S. Pat. App. Publication No. 2011/0070959A1 provides a clip/fastener with a wheel to attach it to the cue shaft, commercially known as "Junior Shark Guiding Wheel". This device is meant to be used with one hand only and it has a lot of restrictions. U.S. Pat. No. 4,053,153 describes a bridge training device including a rigid base and an elongated guide attached to it by a support post of a certain height. U.S. Pat. No. 7,611,416 describes a fix tubular adapter to place the cue stick inside. U.S. Pat. No. 3,416,794 describes a bridge aid-device formed by a ring-shaped member joined to a channel on top of the mentioned ring. Another aid-guide device proposed for a pool or billiard cue is given by U.S. Pat. No. 3,851,876 and provides the user with a rectangular elongate device with a concave cue guide notch that helps the user place the cue stick over it while he/she hits the cue ball. Finally, U.S. Pat. No. 9,539,492 describes a guide rail mounted over a support which can be positioned on either a table or tripod to hit the cue ball from an elevated position. While these patents attempt to provide the user with more stability in their stroke—eliminating almost the formation of the bridge—they all introduce an obstructive member making the billiard and/or pool game more complex.

Consequently, the inventions described in the prior art do not provide the players with a useful solution to improve their pool or billiard performances.

SUMMARY OF THE INVENTION

It is an objective of the present invention to provide a simple, useful, user-friendly and affordable apparatus to improve the efficiency and performance of billiards games players.

According to the foregoing objective, the present invention provides a pool or billiards glove and a cue pilot guide easily attachable to the glove for placing the cue shaft. The mentioned glove exposes the skin of the fourth and fifth fingers of a billiard player's hand to contact the table providing maximum sensitivity to position and control the cue shaft, while simultaneously covers the surfaces of the thumb, index and middle fingers to provide a low friction surface with a basted hook and loop panel capable of attaching the cue pilot guide which provides more control to the movement of the cue stick. In addition, and for the purpose of this invention, the glove incorporates a first type of material, preferred hook and loop (loop side) of any shape, placed on the top side surface of the glove over the thumb, the index finger or the back of the hand, and attached to a second type of material, preferred hook and loop (hook side) on the surface of the cue pilot guide. In a preferred embodiment, the incorporated material to attach the guide pilot to the glove is VELCRO®. The hook and loop panels used in this invention to attach the guide pilot to the glove allows the player to place the cue pilot guide in different directions depending on the shot required during the game. This also provides the player with a practical and useful tool to position the cue stick on the glove without being restricted or limited to a certain position, in comparison with the solutions provide by other inventions (e.g. U.S. Pat. No. 9,067,126 B2). In addition, the player can perform any type of bridges—closed, open or elevated- or play in the table's rails while is using the proposed invention.

Another benefit of having the pilot guide easily attachable and removable from the top surface of the thumb, the index finger or the back of the hand is that the player does not need to adapt any uncomfortable position. This means the player can perform the game while muscles, joints, shoulders and wrists are relaxed.

Further, the design of the pilot provides another novel feature to the invention. In this sense, the cue pilot guide has a tapered structure and is expandable with at least one elastic layer featuring at least one, and preferred three, boning reinforcements. These longitudinal bones can be placed around the circumference of the cue pilot guide, e.g. between at least one elastic layer to maintain rigidity despite the flexible nature. Elastic provides an accurate fit for the tapered shape of the cue shaft. Thus, the design of the panels allows the cue shaft to be held in place in the bridge hand of the player without having to stress the use of the fingers; permits more elevation on closed angles that require a more complex grip; and increases stability of the cue shaft that will indeed reduce miscues.

One of the most common problems that players face is how to control the cue stick while performing the stroke. In the motion of the stroke three axes come in place: the X axis (horizontal); the Y axis (vertical) and the Z axis (represented by the movements back and forth of the cue stick). One way to control the cue stick in the X-Y- and Z directions is to have a solid hand bridge and a solid shoulder-elbow-wrist-backhand coordination. New and amateur players and professionals, on some occasions, face the problem of control because of lack of knowledge, guidance and expertise. However, by just using the glove and the cue pilot guide herein provided, the present invention solves these problems because the apparatus brings a solid hand bridge and cue attachment with an elongated cue pilot guide that will aid to prevent all these unwanted movements. Because of the hand bridge structure, players have to deal with unwanted left to right movements and this is caused by a regular hand bridge, whether open or closed, as the hand does not create enough surface for the cue shaft to travel is too short; thus, the bridge acts as a pivot point rather than a real cue guide for the cue shaft. On the other hand, when the player introduces the cue shaft into the cue pilot guide and securely attaches it to the glove, he/she will be creating a longer surface for the cue shaft to go through, like a real tunnel, and then tremendously reducing the pivot factor that causes sideways or horizontal movements. Secondly, a player needs to have control over vertical movements (up and down) represented on the Y-coordinates axis when performing some shots (e.g. shooting over a ball and jump shots). The problem here is that since an elevated bridge is required, the player cannot wrap the cue shaft with the thumb and the index finger while using an elevated hand bridge. The player will need to do an open bridge which is more difficult in those positions requiring more expertise from the player to avoid miscue, miss the cue ball completely, or cause the cue stick to move away from the player's hand. As a consequence of using the apparatus, the player will need to focus on the target ball and on moving the cue stick back and forth (Z-coordinate axis movements), and as a result, the player will perform the stroke more accurately. Finally, the regular player needs to control the back and forth movements (the Z-coordinate axis movements). Here there is a tendency to make sideways movements as long as the cue stick goes back and forth. These movements are represented by left or right semi-circles on the X-coordinate axis. However, when the player uses the cue pilot guide containing its reinforcements, the player will create a secured guide to slide the cue shaft and eliminate sideways movements. In conclusion, the use of the apparatus presented herein will indeed increase the performance of the player giving the player a more pure stroke.

Finally, the glove with the cue pilot guide described in this invention contains a loop on the bottom center of the palm where a detachable ring is placed. In an alternative embodiment, the apparatus contains a double Y-shaped lanyard containing three scaffold hooks, which may be magnesium oxide (MGO) scaffold hooks. Two scaffold hooks are placed in the lanyard's tips used to attach the lanyard to the player's trousers, and a third adjustable scaffold hook is basted and placed on the center of the Y-shaped lanyard to hook onto the detachable ring on the apparatus to perform an air bridge. The air bridge is a way to hold steady the bridge hand in the air without making contact with the table.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DETAILED DESCRIPTION AND PREFERRED EMBODIMENTS

Figure 1:
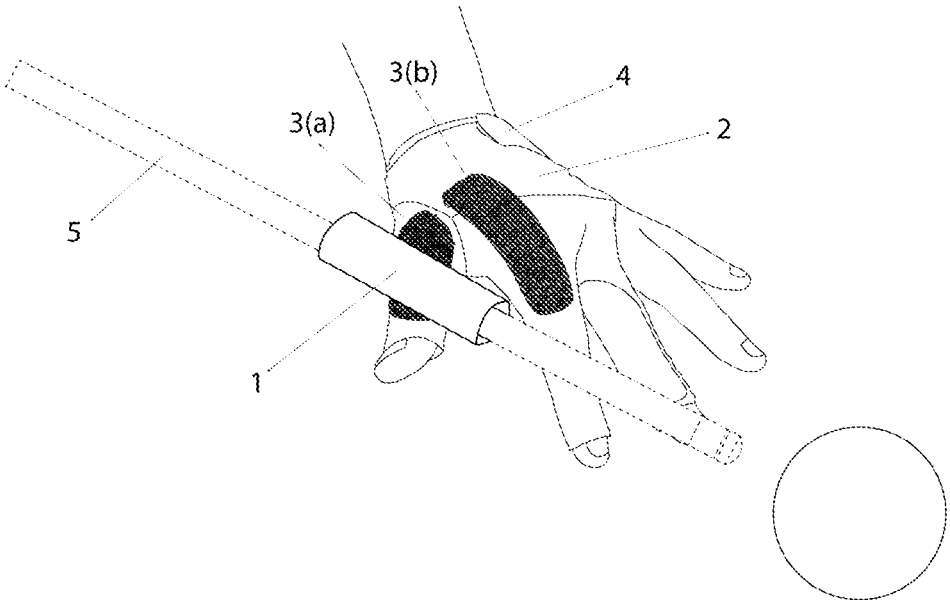
FIG. 1 is an exploded view of the embodiment of the glove and the cue pilot guide according to the present invention.

Referring now to the drawings and particularly to FIG. 1, the pool or billiard glove 2 is shown having attached to it a tapered cue pilot guide 1 inside of it the cue shaft 5 slides smoothly back and forth. The pool or billiard glove 2 incorporates a fastener material such as hook and loop covering the upper surface of the thumb 3(*a*) and the index finger and the back of the hand 3(*b*) serving to attach the cue pilot guide 1 to the glove 2. Finally, FIG. 1 shows in 4 a top closure with adjustable as hook and loop tab.

Figure 2:
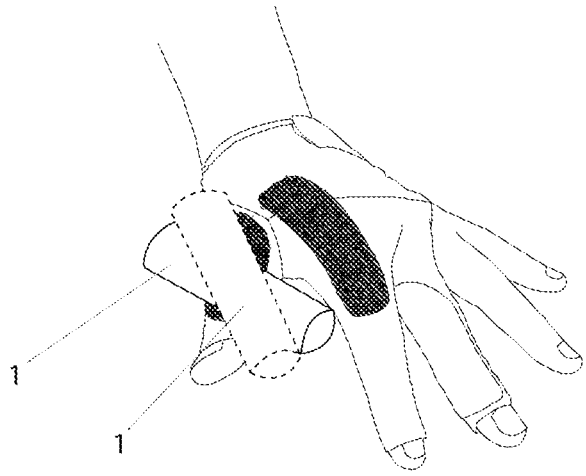
FIG. 2 is a representative view of the embodiment of the cue pilot guide as it is used in different positions when it is attached to the thumb finger.
Figure 3:
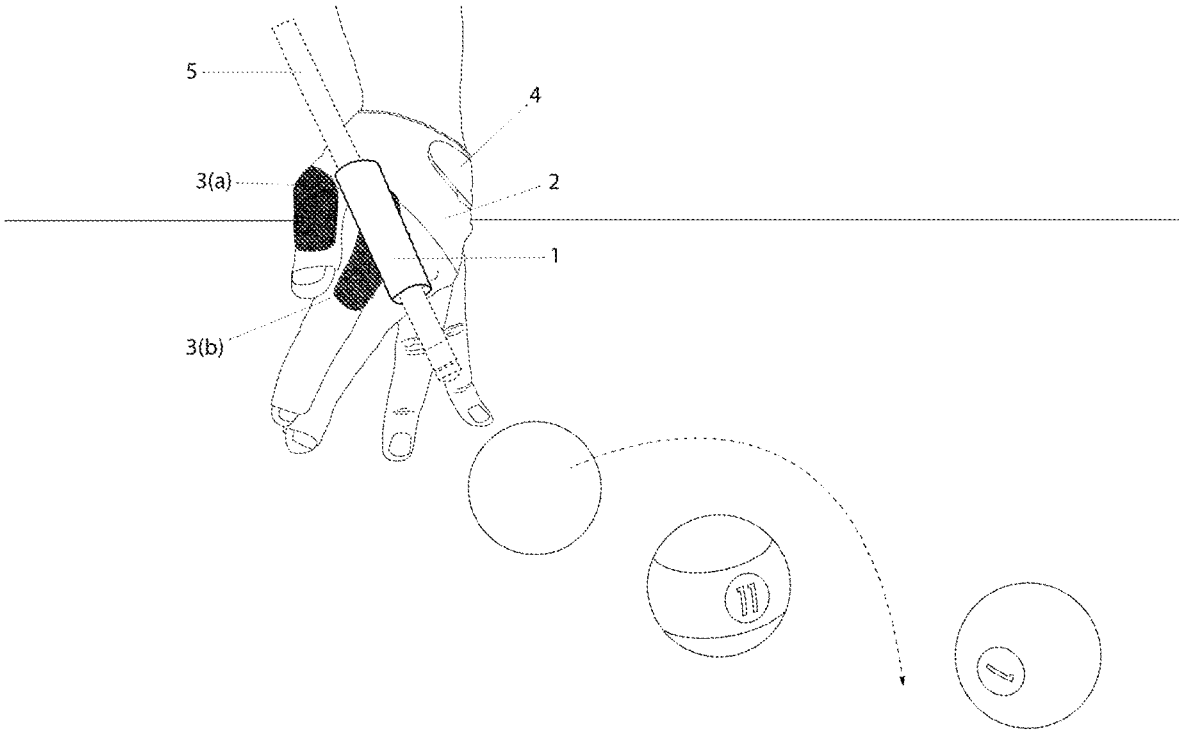
FIG. 3 is a representative view of the embodiment of the cue pilot guide when it is attached to the index finger as when the user performs elevated bridge.

The as hook and loop panels used in the upper surfaces of the thumb 3(*a*) and the index finger 3(*b*) holding the cue pilot guide Tare shown in FIG. 2 and FIG. 3 respectively, allowing the player to place the cue pilot guide 1 in multiple positions as it is described in FIG. 2 depending on the stroke required during the pool or billiards game. FIG. 2 and FIG. 3 show 4 a top closure with adjustable as hook and loop tab.

FIG. 3 shows a player performing an elevated bridge to jump the cue ball attaching the pilot guide 1 on the hook and loop covering the upper surface of the index finger and the back of the hand 3(*b*). The cue shaft 5 goes through the cue pilot guide 1.

Figure 4:
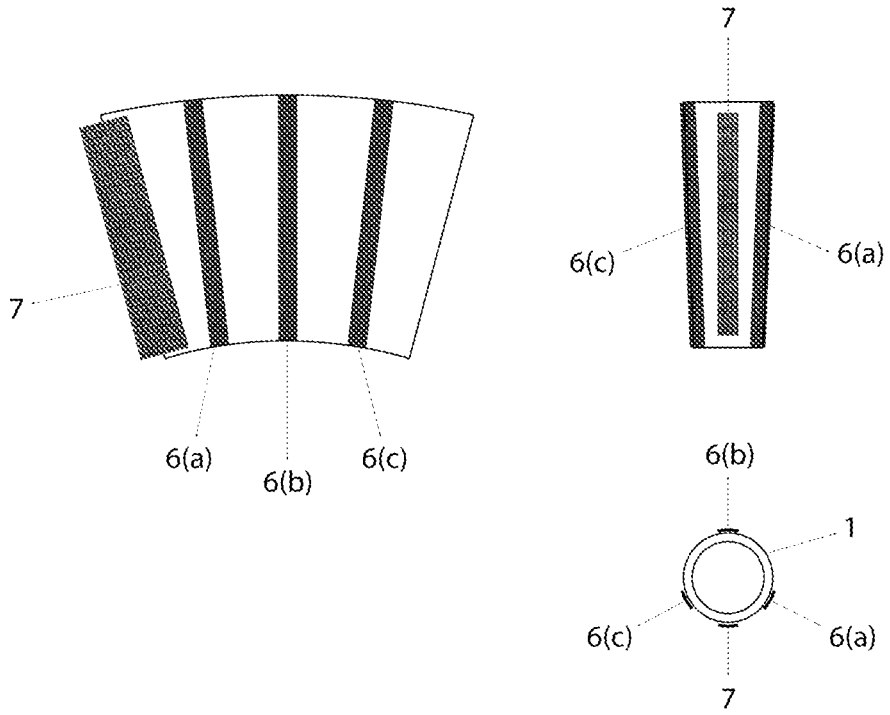
FIG. 4 is a representative view of the embodiment of the cue pilot guide.

FIG. 4 shows three different perspectives of the cue pilot guide 1, showing three boning reinforcements represented in 6(*a*), 6(*b*) and 6(*c*) and a Velcro® band 7 on the cue pilot guide 1. As used herein, the term "boning" refers to a reinforcement common in the clothing arts that is used for, e.g., shirts, bras, corsets, bustiers, swimsuits or strapless gowns, and that can be made from a wide variety of materials or composites, such as, steel boning, Featherlite boning, Flexicurve boning, or other equivalents known to the skilled artisan can include, e.g., metal (commonly steel), polymers, or plastics, that are sewn directly into the glove or that can be placed into pockets formed in the cloth.

Figure 5:
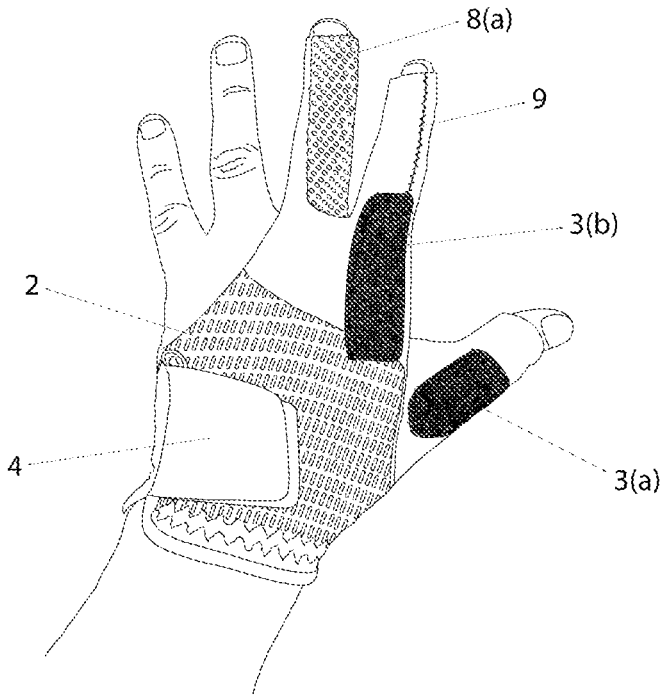
FIG. 5 is a representative view of the embodiment of the glove's back of the hand side.

FIG. 5 shows the back of the hand (top side) having the hook and loop panels covering the upper surface of the thumb 3(*a*) and over the upper surface of the index finger and a portion of the back of the hand 3(*b*). In addition, FIG. 5 shows a reinforcement band 8(*a*) covering the interior side of middle finger. Finally, it is shown on the index finger a flat felled seam on top side 9 so as to help the index finger and the glove 2 have a more comfortable contact with the table.

Figure 6:
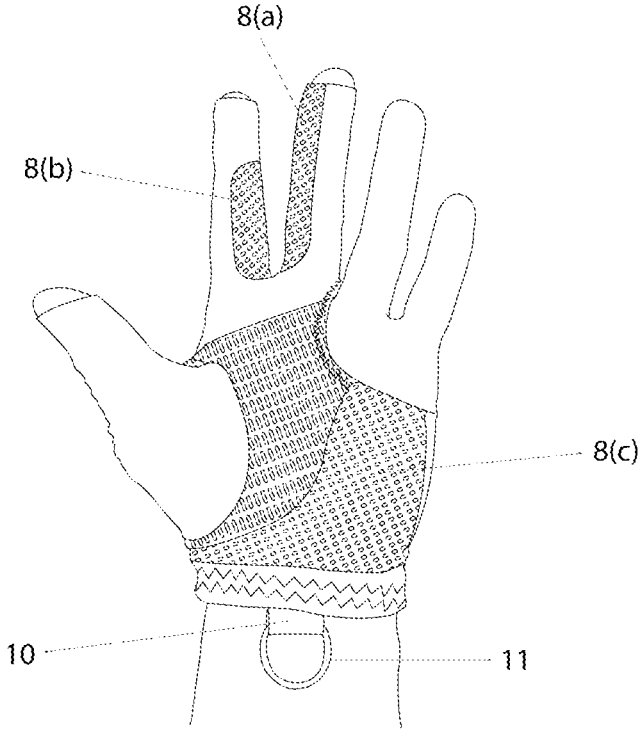
FIG. 6 is a representative view of the embodiment of the glove's palm side.
Figure 7:
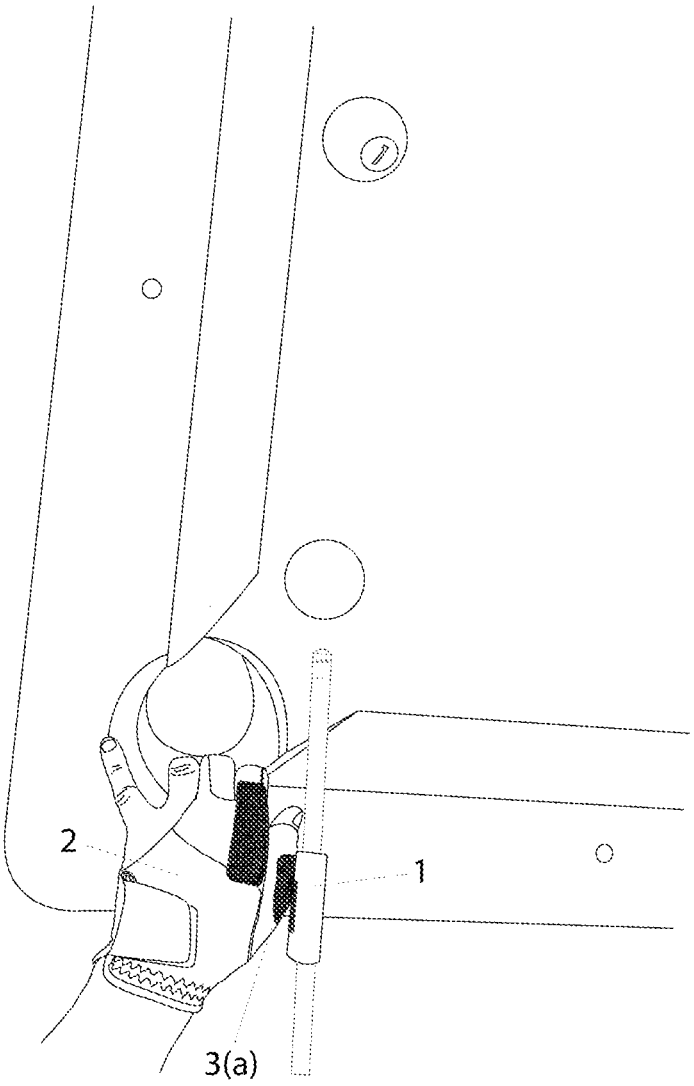
FIG. 7 is a representative view of the cue pilot guide being used over the rail.

FIG. 6 shows the palm side of the glove 2 having three reinforcement portions represented by 8(*a*), 8(*b*) and 8(*c*). On the button center of the palm, the glove 2 has a loop 10 where a detachable ring 11 is placed. FIG. 7 shows the glove 2 and cue pilot guide 1 being used over the railing of the pool table showing the cue pilot guide 1 attached to the hook and loop panel covering the upper side of the thumb 3(*a*) totally flat against the mentioned rail.

Figure 8:
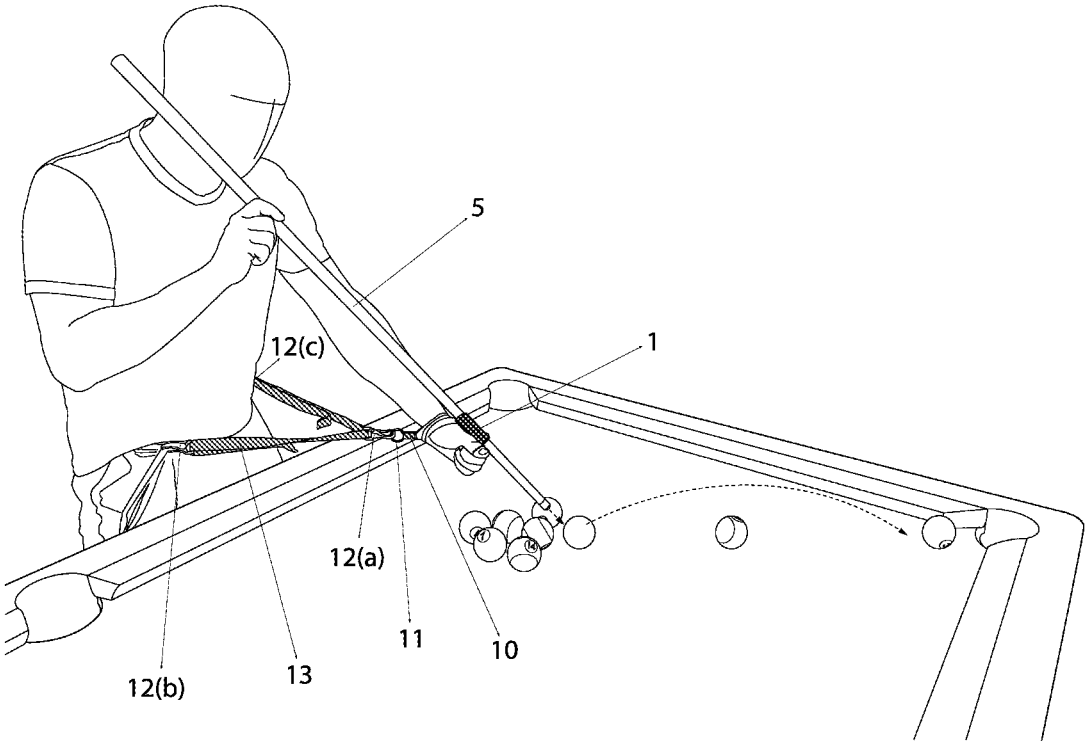
FIG. 8 is a representative view of the embodiment with the attached rings and Y-shaped lanyard used to perform an air bridge.

In an alternative embodiment shown in FIG. 8, the apparatus contains a double Y-shaped lanyard 13 containing three scaffold hooks, e.g., magnesium oxide (MGO) scaffold hooks. Two scaffold hooks are placed in the lanyard tips 12(*b*) and 12(*c*) used to attach the Y-shaped lanyard to the player's trousers, belt or clothing, and a third adjustable scaffold hook 12(*a*) is basted and placed on the center of the Y-shaped lanyard 13 to hook onto the detachable ring 11 on the apparatus 1 to perform an air bridge. The air-bridge is a way to hold steady the bridge hand in the air without making contact with the table.

Although this invention has been described in detail with particular reference to the preferred embodiments, other embodiments can achieve almost the same results. Variations and modifications of the present invention will be considered obvious to those skilled in the art and it is intended to cover in the appended claims all such modifications and equivalents.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), property(ies), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skill in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

To aid the Patent Office, and any readers of any patent issued on this application in interpreting the claims appended hereto, applicants wish to note that they do not intend any of the appended claims to invoke paragraph 6 of 35 U.S.C. § 112 as it exists on the date of filing hereof unless the words "means for" or "step for" are explicitly used in the particular claim.

For each of the claims, each dependent claim can depend both from the independent claim and from each of the prior dependent claims for each and every claim so long as the prior claim provides a proper antecedent basis for a claim term or element.

What is claimed is:

1. An apparatus for playing billiard games comprising:

(a) a glove adapted to cover at least a portion of a palm and aback of a player's hand and adapted to be secured to the hand, wherein the back surface of the glove comprises one or more fastener panels located on at least one or more of the following portions of the glove: a side or upper surface of an index, middle finger, or thumb, or a portion of a back of the glove;

(b) a cue pilot guide attachable to, and repositioned from, the one or more fastener panels, and wherein said cue pilot guide is characterized as having a hollow structure of expandable elastic.

2. The apparatus for playing billiard games of claim 1, wherein the hollow structure of the cue pilot guide is selected from the group consisting of: tapered, cylindrical, tubular, and a combination thereof.

3. The apparatus for playing billiard games of claim 1, wherein the cue pilot guide is attachable to the glove by a fastener material selected from the group consisting of: hook and loop, magnet, removable adhesive, pine tar, a suction cup, a snap, and a combination thereof.

4. An apparatus for playing billiard games comprising:

(a) a glove adapted to cover at least a portion of a palm and aback of a player's hand and adapted to be secured to the hand, wherein the back surface of the glove comprises one or more fastener panels located on at least one or more of the following portions of the glove: a side or upper surface of an index, middle finger, or thumb, or a portion of a back of the glove;

(b) a cue pilot guide attachable to, and repositioned from, the one or more fastener panels, wherein said cue pilot guide is characterized as having a hollow structure of expandable elastic;

(c) a loop and a detachable ring on the center of the bottom portion of the palm; and (d) a Y-shaped lanyard containing two adjustable scaffold hooks in a tip of the lanyard and one adjustable scaffold hook in the lanyard, or (e) a closed lanyard containing, at least, an adjustable scaffold hook in the lanyard.

5. The apparatus for playing billiard games of claim 4, wherein the hollow structure of the cue pilot guide is selected from the group consisting of: tapered, cylindrical, tubular, and a combination thereof.

6. The apparatus for playing billiard games of claim 4, wherein the tip of the lanyard attaches to a belt, trousers or clothing.

7. A cue pilot guide and a glove for playing billiard games comprising:

one or more fastener panels on a back surface of the glove, wherein the one or more fastener panels are located on at least one of: a side or upper surface of an index, middle finger, and thumb, or a portion of a back of the glove;

wherein the cue pilot guide is repositioned to any of the one or more fastener panels, and wherein the cue pilot guide is characterized as having a hollow structure of expandable elastic.

8. The cue pilot guide for playing billiard games of claim 7, wherein the hollow structure of the cue pilot guide is selected from the group consisting of: tapered, cylindrical, tubular, and a combination thereof.

9. The cue pilot guide for playing billiard games of claim 7, wherein the fastener material is selected from the group consisting of: hook and loop, magnet, removable adhesive, pine tar, a suction cup, a snap, and a combination thereof.

10. A method of using an apparatus for playing billiard games comprising:

obtaining an apparatus comprising:

(a) a glove adapted to cover at least a portion of a palm and aback of a player's hand and adapted to be secured to the hand, wherein the back surface of the glove comprises one or more fastener panels located on at least one or more of the following portions of the glove: a side or upper surface of an index, middle finger, or thumb, or a portion of a back of the glove; and (b) a cue pilot guide attachable to, and repositioned from, the one or more fastener panels, said cue pilot guide characterized as having a hollow structure of expandable elastic;

and controlling a movement of a pool cue by inserting the cue into the cue pilot guide that is attached to the glove thereby providing enhanced control over the pool cue in all directions.

11. The method for playing billiard games of claim 10, wherein the hollow structure of the cue pilot guide is selected from the group consisting of: tapered, cylindrical, tubular, and a combination thereof.

12. The method for playing billiard games of claim 10, wherein the cue pilot guide is attachable to the glove by a fastener material selected from the group consisting of: hook and loop, magnet, removable adhesive, pine tar, a suction cup, a snap, and a combination thereof.

13. The method for playing billiard games of claim 10, wherein the apparatus further comprises: a loop and a detachable ring on the center of the bottom portion of the palm.

14. The method for playing billiard games of claim 10, wherein the apparatus further comprises: a Y-shaped lanyard containing two adjustable scaffold hooks in the lanyard's tips and one adjustable scaffold hook in the lanyard.

15. The method for playing billiard games of claim 10, wherein the apparatus further comprises: a closed lanyard containing, at least, an adjustable scaffold hook in the lanyard.

* * * * *